US006092235A

United States Patent [19]

Santa Cruz et al.

[11] Patent Number: 6,092,235

[45] Date of Patent: Jul. 25, 2000

[54] WEATHER-PROOF WRIST, FOREARM, AND ELBOW PROTECTORS

[76] Inventors: Cathy D. Santa Cruz, 7630 Tholl Dr., Reno, Nev. 89506; Christine L. Deniston-Korgol, 3501 Northgate La., Carson City, Nev. 89706; Barbara I. Baugh, 3501 Northgate La., Carson City, Nev. 89706; Alexandria D. Baugh, 3501 Northgate La., Carson City, Nev. 89706; Roger D. Baugh, 3501 Northgate La., Carson City, Nev. 89706

[21] Appl. No.: 09/379,709

[22] Filed: Aug. 24, 1999

[51] Int. Cl.[7] ..... A41D 13/08

[52] U.S. Cl. ..... 2/16; 2/59; 2/93; 2/125; 2/159

[58] Field of Search ..... 2/16, 22, 59, 125, 2/243.1, 242, 126, 93, 158–160, 162, 170; 128/878, 881, 882; 602/21, 62–64

[56] References Cited

U.S. PATENT DOCUMENTS

| | | | |
|---|---|---|---|
| 3,889,297 | 6/1975 | Jarboe et al. | 2/16 |
| 4,356,570 | 11/1982 | Vernon et al. | 2/16 |
| 4,856,112 | 8/1989 | Effle | 2/59 |
| 5,388,270 | 2/1995 | Hewitt | 2/93 |
| 5,477,633 | 12/1995 | Leinberger | 40/661 |
| 5,592,953 | 1/1997 | Delao | 602/3 |
| 5,638,546 | 6/1997 | Vita | 2/16 |
| 5,642,525 | 7/1997 | Ketola | 2/16 |
| 5,749,098 | 5/1998 | Evans | 2/123 |
| 5,878,435 | 3/1999 | Kast et al. | 2/159 |
| 5,909,801 | 6/1999 | Coffman | 2/16 |
| 5,924,130 | 7/1999 | Fragomeli | 2/16 |
| 5,974,586 | 11/1999 | Reinoso | 2/16 |
| 6,006,357 | 12/1999 | Mead | 2/160 |

*Primary Examiner*—John J. Calvert
*Assistant Examiner*—Tejash Patel

[57] ABSTRACT

A pair of accessory protectors which are used to prevent skin exposure to extreme cold or snow. The protectors are each worn in combination over a users glove, or mitten, and coat sleeve simultaneously, and eliminate possible intrusion from snow which would otherwise intrude in between the wearers glove and coat sleeve.

17 Claims, 2 Drawing Sheets

WEATHER-PROOF WRIST, FOREARM, AND ELBOW PROTECTORS

FIELD OF THE INVENTION

An accessory winter clothing article which is used to prevent skin exposure to extreme cold or snow, but more particularly pertains to a clothing article which is worn over a users glove and coat sleeve simultaneously.

BACKGROUND OF THE INVENTION

In the past, gloves have been used for various purposes of user choice. For example, motorcycle riders and bicyclists have used gloves for protection against road-burns and also they are used for improving a user's grip when grasping an object, such as a handgrip or the like.

Other gloves are used for sanitation purposes, such as surgical gloves, etc. Or they may be used to protect a user from contact with harsh chemicals, such as rubber gloves, or the like.

The above noted gloves are useful for their intended purposes, but they are not commonly used for protecting a user from exposure to freezing conditions, or the like.

Still other gloves are designed specifically for protecting a user's hands from exposure to freezing conditions and they may be made from an insulating material which also provides increased warmth when worn by a user. However, such gloves only provide coverage and protection for the hands and perhaps the wrist of the user, and they do not provide protection of the forearm and elbow of the user, which is most unfortunate.

Furthermore, it is well known by most people when playing or participating in sports activities in the snow, even when wearing gloves and a coat, snow invariably intrudes inside, between the gloves and coat sleeve. Thus, exposing the user to extreme cold and ruining play time in the snow. Needless to say, this is not only irritating, but can be very dangerous as well, as one can experience severe frost bite if exposed for too long.

Therefore, many attempts have been made to provide a clothing article which overcomes the misgivings of the above noted gloves.

For example, U.S. Pat. No. 5,722,092 provides a "PROTECTIVE ARM AND WRIST GUARD" which is used to protect the wearer from serious injury, such as fractures or the like which may be incurred during sports events, etc. This guard is very useful for its intended purpose because it is made from a rigid material and acts like a cast when worn, but it is not used for increased warmth nor is it designed to protect against exposure to freezing weather conditions.

Yet other examples include U.S. Pat. No. 5,761,746 and U.S. Pat. No. 5,592,953, wherein they provide a "WATERPROOF SLEEVE" which is used to keep exposed injuries from becoming wet during bathing or showering. Again, these are most useful for their intended purpose but they cannot be used for protecting the user from exposure to extreme cold, or the like.

The closest prior art reference the applicants found is U.S. Pat. No. 5,722,092, entitled "PROTECTIVE ARM AND WRIST GUARD". This device is somewhat functional for use while snowboarding as is the present invention, but this device is much too complicated, as it includes belt buckles, straps and VELCRO, and it is made from a rigid material. Thus it is unlikely that this device would become popular, as it would be like wearing a cast which is most uncomfortable and much too restrictive.

Furthermore, nowhere in the prior art did the applicants find a clothing article that is specifically used in combination with gloves and coat sleeves, as taught by the present invention.

SUMMARY OF THE INVENTION

It is therefore a primary object of the present invention to provide a pair of wrist, forearm and elbow protectors that can be worn in combination with a pair of gloves and a coat having coat sleeves.

It is another object of the present invention to manufacture the above noted protectors from a material which is water-proof and insulated.

The most important object of the present invention is to provide a pair of protectors which when worn with a pair of gloves and a coat having sleeves, will not allow snow or the like to accidentally enter and contact the skin of the wearer.

Still another object of the present invention is to provide a pair of protectors which may be easily produced in various sizes of engineering choice. Such as small medium and large, or the like. Or if preferred the protectors may be made as a one size fits all, depending on engineering choice.

Also another object of the present invention is to provide a pair of protectors which when produced may have different designs thereon, such as cartoon characters or the like, so as to make the protectors appealing to children.

Yet another object is to provide a pair of protectors which may be made having various types of fastener or adjustment means of engineering choice, such as VELCRO, snaps, buttons, etc.

Another object of the present invention is to provide a pair of protectors which are of a length to extend from the palm of the hand past the elbow, respectively.

Still another of the present invention is to provide a pair of protectors that may be produced in a florescent color such as orange. This would be most helpful if the user were to be lost in the snow, as they would be much easier to find.

Also, another object of the present invention is to provide a pair of protectors which may include a pocket thereon, such as for containment of keys or the like.

Yet another object of the present invention is to provide a pair of protectors which may include an identification compartment. Thus, if the wearer were hurt, emergency help would be able to identify the victim and contact family members for assistance.

Other objects and advantages will become apparent when taken into consideration with the following drawings and specification.

DETAILED DESCRIPTION OF THE DRAWINGS

Figure 1:
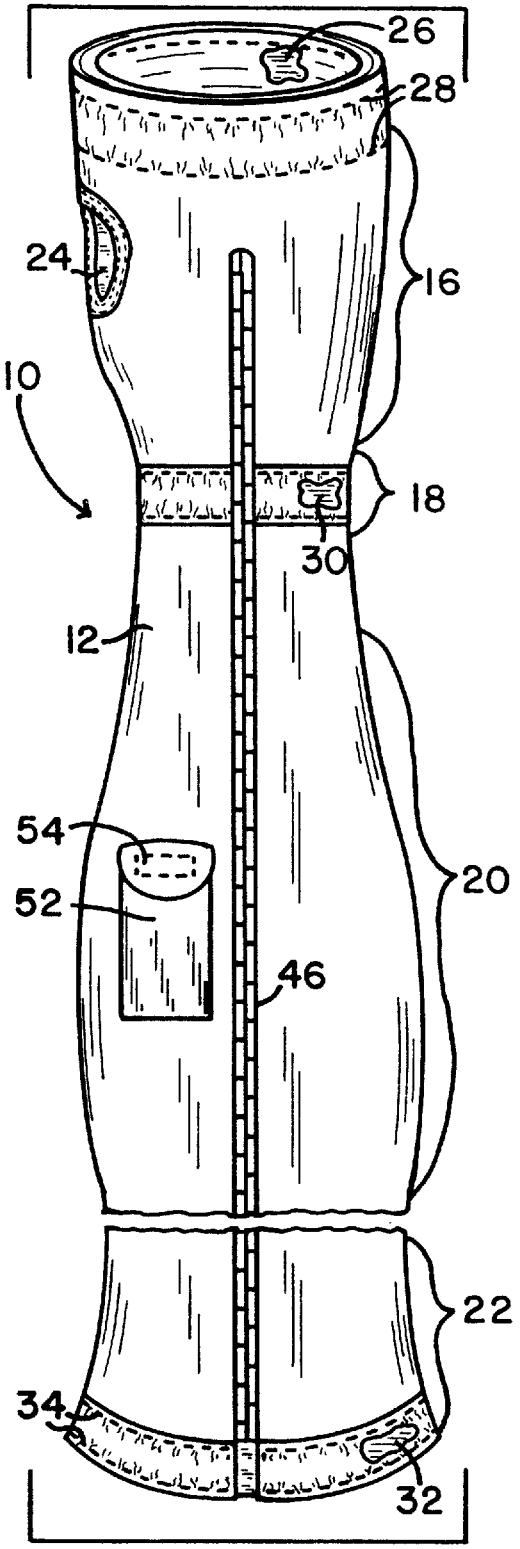
FIG. 1 is substantially a perspective overview of a left hand protector of the present invention.
Figure 2:
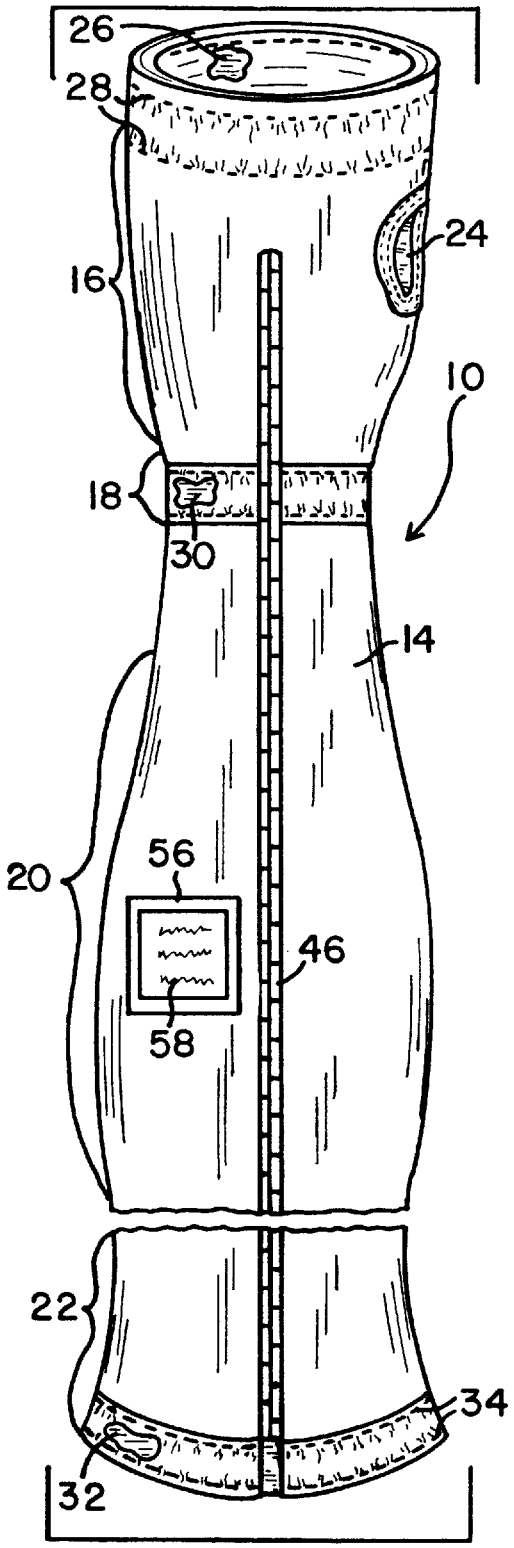
FIG. 2 is substantially a perspective overview of a right hand protector of the present invention.

Referring now in detail to the drawings wherein like characters refer to like elements throughout the various views. In FIGS. 1 & 2, (arrow 10) substantially represents an overview of the preferred embodiment for the present invention. Which is substantially a pair of weather-proof wrist, forearm, and elbow protectors that are used in combination with a pair of either gloves or mittens, and coat sleeves. It is to be noted protectors (arrow 10) may be made from any suitable weather-proof insulated non-rigid material of engineering choice, such as POLYESTER, NYLON, POLYFILL, etc. Also, it is to be understood protectors (arrow 10) can be manufactured in any suitable shape or size of engineering choice, such as protectors (arrow 10) may be sold in toddler sizes as well as adult sizes.

In FIG. 1 we show a left hand protector (12) and in FIG. 2 we show a right hand protector (14). With each protector (12 & 14) being of a length to extend from substantially the palm of the user past the elbow of the user. Each protector (12 & 14) having a palm section (arrow 16), a wrist section (arrow 18), a forearm section (20) and an elbow section (22). Each palm section (arrow 16) includes attachment means for removably attaching palm section (arrow 16) to either a glove or mitten, later described. Each protector (12 & 14) further includes attachment means for attaching elbow section (22) to a coat sleeve, later described. Still further, each protector (12 & 14) includes closure means for retaining each protector (12 & 14) in a closed position, later described. Whereby, when a user is wearing in combination, a pair of gloves, a coat having sleeves, and each protector (12 & 14), the user is protected from foreign objects, such as snow, which would otherwise intrude between each glove and each sleeve.

It is to be noted the previously mentioned attachment means for attaching the palm section (16) to a glove may be any suitable attachment means of engineering choice, such as a protruding thumb member or the like. Or as the applicants prefer, the attachment means for attaching palm section (16) to either a glove or a mitten, is by each palm section (16) having a thumb recess (24), which is of a shape and size to receive the thumb of the user there through, while the user is wearing a glove or mitten. Also, if preferred thumb recess (24) may be elasticized so as to insure a secure fit.

Still further, each protector (12 & 14) may include additional attachment means for attaching palm section (16) to a glove, such as by each palm section (16) having an elastic band (26) which is secured in place by stitching (28), or the like. However, any other suitable attachment means of engineering choice may be used, such as a draw string or the like. Thus, each protector (12 & 14) is substantially adjustable and will fit different sized gloves or mittens while being worn by the user.

Each protector (12 & 14) may further include additional adjustment means which provides a secure fit, such as wrist section (18) further includes an elastic band (30), or the like.

Referring now to each elbow section (22) which also includes attachment means of engineering choice for attaching elbow section (22) to a coat sleeve. For example, in FIGS. 1 & 2, the attachment means for attaching elbow section (22) to a coat sleeve is by each elbow section (22) having an elastic band (32) therein, which is secured in place by stitching (34), or the like, and provides substantially an adjustable secure fit.

Another example of attachment means for attaching elbow section (22) to a coat sleeve includes each elbow section (22) having at least one strap. For example in FIG. 3, we show a first strap (36) and a second strap (38), with each strap (36 & 38) having adjustable closure means of engineering choice thereon, such as VELCRO (40), or the like.

Figure 4:
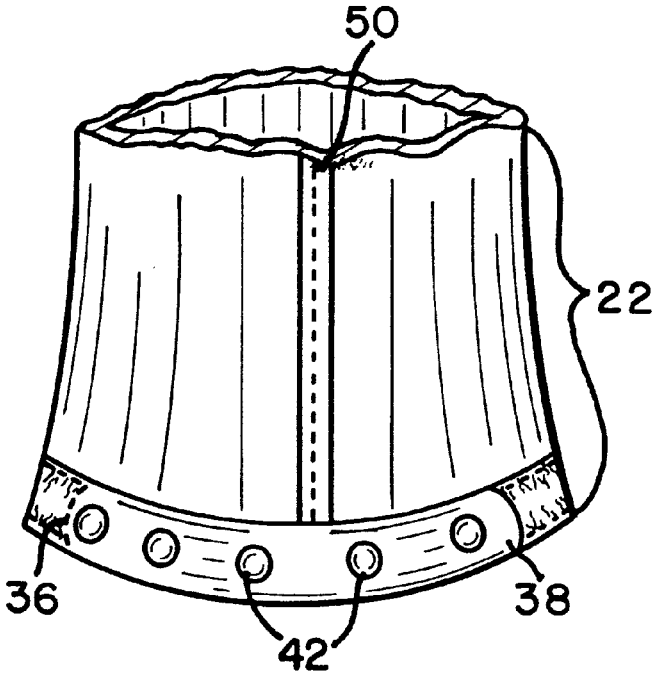
FIG. 4 is substantially a partial perspective view of an elbow section showing a different embodiment for the present invention.

Yet another example of a suitable attachment means for attaching elbow section (22) to a coat sleeve is illustrated in FIG. 4. Wherein we show a first strap (36) and a second strap (38), with each strap (36 & 38) having adjustable closure means of engineering choice thereon, such as snaps (42), buttons, or the like. Thus, elbow section (22) is adjustable and will fit onto substantially any sized coat sleeve while the coat is being worn by the user.

It is to be understood each protector (12 & 14) also includes closure means as previously noted for retaining each protector (12 & 14) in a closed position. For example, within FIGS. 1 & 2, each protector (12 & 14) includes an elongated opening (44) having the noted closure means thereon. It is to be understood any suitable type of closure means of engineering choice may be used, such as a zipper (46) which preferably is made of plastic and will be resistant to corrosion.

Figure 3:
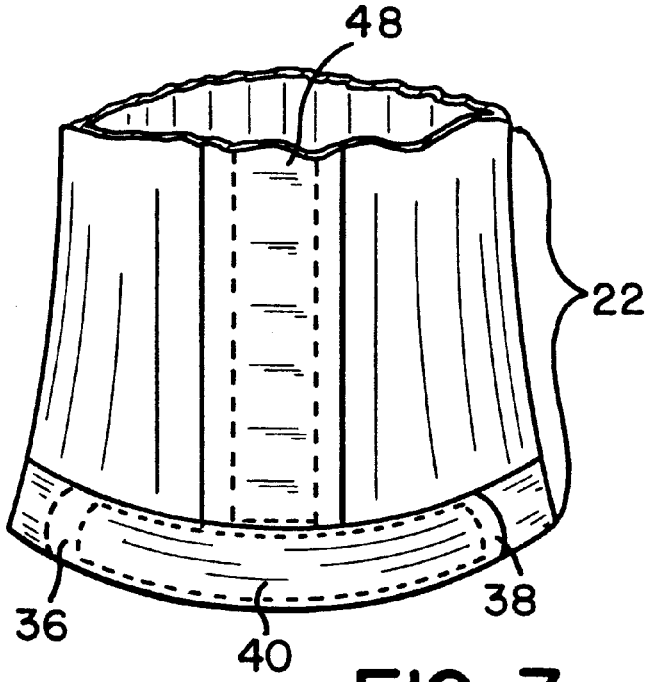
FIG. 3 is substantially a partial perspective view of an elbow section of the present invention.

Yet another suitable closure means for retaining each protector (12 & 14) in a closed position is illustrated in FIG. 3, wherein we show in ghost lines the closure means being of the loop and pile variety, such as VELCRO (48).

Still another suitable closure means for retaining each protector (12 & 14 ) in a closed position is illustrated in FIG. 4, wherein we show substantially in ghost lines the closure means being a ZIP-LOCK (50), such as used on ZIP-LOCK sandwich bags.

Furthermore if so desired, one of each protector (12 & 14) may include a pocket (52) for containment of an object of user choice, such as a key or the like. With pocket (52) having closure means of engineering choice, such as VELCRO (54) which is shown in ghost lines in FIG. 1. Or if preferred, one of each protector (12 & 14) may include an identification compartment (56) which is used for containment of information about the user. With the compartment (56) having a transparent cover (58) which allows the information about the user to be easily visible when viewed there through.

The present invention further includes a method for using a pair of weather-proof wrist, forearm, and elbow protectors (12 & 14) which are used in combination with a pair of gloves and coat sleeves comprising of the following steps:

a. grasping a coat having sleeves;
b. putting on the coat in the normal manner;
c. grasping a pair of gloves;
d. putting on the gloves in the normal manner;
e. grasping a right hand protector (14);
f. inserting the gloved right hand of the user into the palm section of the right hand protector (14);
g. inserting the gloved thumb of the user into the thumb recess (24) on right hand protector (14);
h. adjusting and positioning right hand protector (14) on top of the right side coat sleeve at a location of user choice;
i. affixing right hand protector (14) on top of right side coat sleeve using a closure means, such as zipper (46);
j. grasping a left hand protector (12);
k. inserting the gloved left hand of the user into the palm section of left hand protector (12);
l. inserting the gloved thumb of the user into the thumb recess (24) on left hand protector (12);
m. adjusting and positioning left hand protector (12) on top of the left side coat sleeve at a location of user choice; and;
n. affixing left hand protector (12) on top of left side coat sleeve using a closure means, such as zipper (46);

whereby:

when the user is wearing in combination, a pair of gloves; a coat having sleeves; and each protector (12 & 14);, the user is protected from foreign objects which would otherwise intrude between each glove and each sleeve.

It will now be seen we have herein provided a pair of weather-proof wrist, forearm and elbow protectors which will eliminate intrusion of foreign objects and will protect the wearer especially in cold conditions.

It will also be seen we have herein provided a pair of weather-proof wrist, forearm and elbow protectors that are economical to manufacture, may include an identification compartment, or a pocket, or a combination of both. The protectors may be made from a fluorescent material so as to allow the user to be easily visually found in the event of an accident. The protectors may be made in various sizes so as to be universal in size and they are adjustable.

Although the invention has been herein shown and described in what is conceived to be the most practical and preferred embodiment, it is recognized that departures may be made therfrom within the scope and spirit of the invention, which is not to be limited to the details disclosed herein but is to be accorded the full scope of the claims so as to embrace any and all equivalent devices and apparatus's.

Having described our invention, what we claim as new and wish to secure by Letters Patent is:

1. A pair of weather-proof wrist, forearm, and elbow protectors which are used in combination with a pair of gloves and coat sleeves comprising: a right hand protector and a left hand protector, each said protector being of a length to extend from the palm of the user past the elbow of said user, each said protector having a palm section, a wrist section, a forearm section and an elbow section, said palm section having attachment means for attaching said palm section to a glove, said elbow section having attachment means for attaching said elbow section to a coat sleeve, and each said protector having closure means for retaining each said protector in a closed position, wherein the combination of gloves, coat, and protectors provide protection from foreign objects through the attachment of the protectors with the glove and sleeve.

2. Each said protector of claim 1 is made from an insulated non-rigid material.

3. Each said protector of claim 1 wherein said attachment means for attaching said palm section to said glove is by each said palm section having a thumb recess.

4. Each said protector of claim 3 wherein said attachment means for attaching said palm section to said glove is by each said palm section having an elastic band.

5. Each said protector of claim 1 wherein said elbow section having attachment means for attaching said elbow section to a coat sleeve is by each said elbow section having an elastic band.

6. Each said protector of claim 1 wherein said elbow section having attachment means for attaching said elbow section to a coat sleeve is by each said elbow section having at least one strap, and said strap having adjustable closure means thereon.

7. Each said protector of claim 6 wherein said adjustable closure means is snaps.

8. Each said protector of claim 1 wherein said wrist section further includes an elastic band.

9. Each said protector of claim 1 wherein each said protector having closure means for retaining each said protector in a closed position is by each said protector having an elongated opening, with said elongated opening having said closure means thereon.

10. Each said protector of claim 9 wherein last said closure means is a zipper.

11. Each said protector of claim 9 wherein last said closure means is a fastener of the loop and pile variety.

12. Each said protector of claim 9 wherein last said closure means is a fastener of the ZIP-LOCK variety.

13. Each protector of claim 1 is made from a florescent material.

14. One of each protector of claim 1 further includes an identification compartment.

15. One of each protector of claim 1 further includes a pocket.

16. A pair of weather-proof wrist, forearm, and elbow protectors which are used in combination with a pair of mittens and coat sleeves comprising: a right hand protector and a left hand protector, each said protector being of a length to extend from the palm of the user past the elbow of said user, each said protector having a palm section, a wrist section, a forearm section and an elbow section, said palm section having attachment means for attaching said palm section to a mitten, said elbow section having attachment means for attaching said elbow section to a coat sleeve, and each said protector having closure means for retaining each said protector in a closed position, wherein the combination of gloves, coat, and protectors provide protection from foreign objects through the attachment of the protectors with the glove and sleeve.

17. A method for using a pair of weather-proof wrist, forearm, and elbow protectors which are used in combination with a pair of gloves and coat sleeves comprising of the following steps:

a. grasping a coat having sleeves;

b. putting on said coat in the normal manner;

c. grasping a pair of gloves;

d. putting on said gloves in the normal manner;

e. grasping a right hand protector;

f. inserting the gloved right hand of the user into the palm section of said right hand protector;

g. inserting the gloved thumb of the user into the thumb recess on said right hand protector;

h. adjusting and positioning said right hand protector on top of the right side coat sleeve at a location of user choice;

i. affixing said right hand protector on top of said right side coat sleeve using a closure means;

j. grasping a left hand protector;

k. inserting the gloved left hand of the user into the palm section of said left hand protector;

l. inserting the gloved thumb of the user into the thumb recess on said left hand protector;

m. adjusting and positioning said left hand protector on top of the left side coat sleeve at a location of user choice; and;

n. affixing said left hand protector on top of said left side coat sleeve using a closure means;

whereby:

when said user is wearing in combination, said pair of gloves; said coat having sleeves; and each said protector; said user is protected from foreign objects which would otherwise intrude between each said glove and each said sleeve.

* * * * *